US006398659B1

(12) United States Patent
Karg

(10) Patent No.: US 6,398,659 B1
(45) Date of Patent: Jun. 4, 2002

(54) CHILDRENS MAZE GAME APPARATUS

(76) Inventor: Ellen Chapman Karg, 35 St. Joe Ter., Cliftwood Beach, NJ (US) 07735

( * ) Notice: Subject to any disclaimer, the term of this patent is extended or adjusted under 35 U.S.C. 154(b) by 0 days.

(21) Appl. No.: 09/597,391

(22) Filed: Jun. 19, 2000

(51) Int. Cl.[7] ..... A63J 11/00
(52) U.S. Cl. ..... 472/62; 160/135
(58) Field of Search ..... 472/57, 62; 100/351, 100/135, 900, 901, 903; 52/79, 239

(56) References Cited

U.S. PATENT DOCUMENTS 1,606,401 A * 11/1926 Craft ..... 160/351
4,154,440 A 5/1979 Rusk
4,685,484 A * 8/1987 Moneta ..... 135/117
4,850,592 A 7/1989 Winter
5,046,720 A 9/1991 Bolly
5,352,149 A * 10/1994 Melashenko et al. ..... 446/178
5,364,311 A 11/1994 Chou
5,474,501 A * 12/1995 Teng ..... 472/62

* cited by examiner

*Primary Examiner*—Kien T. Nguyen
(74) *Attorney, Agent, or Firm*—Roger M. Rathbun

(57) ABSTRACT

An apparatus is disclosed comprising a light weight maze game that can be used indoors or outdoors and which has light weight vertical poles and horizontal poles that interconnect together to make up the frame of the maze apparatus. The panels are made of a light weight fabric and are readily attached and detached from the horizontal poles such the panels hang downwardly from the horizontal poles to establish the various isolated pathways through the maze. By the construction, the maze apparatus can be set up easily and quickly by a user and the vertical height of the panels can be selected by the user for differing heights of the children.

14 Claims, 3 Drawing Sheets

CHILDRENS MAZE GAME APPARATUS

BACKGROUND

The present invention relates to apparatus for setting up and playing a children's game, and, more particularly, to a maze game that can readily be set up indoors or outdoors and which is comprised of light, easy to assemble construction components.

The use of a maze or labyrinth as a basis for a children's game is well known and there have been many differing types of apparatus to establish the basic maze for the enjoyment of the children. Basically, the maze is set up so that the children can proceed down a particular path and are not readily visible to other children in the same maze such that each child wends a unique path and chances an encounter with another child. With a typical maze set up, there are certainly many games that can thus be played and with certain of the maze setups, the children themselves can improvise and make up their own games for amusement.

One of the more simple games enjoyed by children with a maze arrangement is to chase each other through the maze in an effort, simultaneously, to catch and evade each other as they progress through the intricate passageways therethrough.

Despite the seemingly availability of the construction materials for a maze, there are no such games or kits that can conveniently be provided to a parent and which can be easily set up, stored and moved with a minimum of difficulty. Thus, while someone could probably individually purchase various equipment and materials to construct a maze, there is no convenient source of the assemblage of materials available in a form that can be used by the parent to readily set up the maze expeditiously and that is adaptable to be used indoors or outdoors.

For example, in U.S. Pat. No. 4,154,440 of Rusk, there is a maze apparatus where the maze is comprised of posts that are driven into the ground and which are interconnected by panels that are made out of a rigid material such as wood. Thus, the maze of the Rusk patent is a permanent structure, intended only for outdoor use and is not of the type that can be used by children where it is advantageous to be able to quickly set up the apparatus for the game and, just as quickly and easily, disassemble the maze apparatus when the game had ended.

In U.S. Pat. No. 5,364,311 of Chou, the is a collapsible maze that is stated to be intended for use by both children and adults. However, in this patent, there are various support members that are specially designed so as to fit into preformed holes in the ground surface and there are a plurality of collapsible wall board panels that comprise a pair of wall sections joined together with an interlocking projection and, again, would not be easy to set up and take down and requires some permanent structure requirements. Too, if the Chou maze is used indoors, it is necessary to provide the holes in the surface on which the apparatus is located and thus not suitable for use in a household. As with the prior Rusk patent, the apparatus is of a more permanent nature and requires considerable structure to establish the maze or labyrinth, and that permanence is due, in part, to the use of wall board or wooden panels that are considerably heavy, rigid and certainly difficult for the parent to quickly set up at the behest of a child that is, no doubt, ready to play the game immediately Thus, it would be advantageous in view of both Rusk and Chou to have a maze apparatus that could be lightweight so as to be easily moved to a location by a parent, set up at that location, be it indoor or outdoors, and then removed after the game has terminated.

A further maze apparatus is shown in U.S. Pat. No. 5,046,720 of Bolly and, again, there is a maze that would be extremely cumbersome and difficult for the normal parent to assembly and to disassembly. In the Bolly construction the maze is constructed of a flexible material of a fairly heavy material such as cloth-backed vinyl and thus the material used in this patent is at least lighter and more portable than in the Chou and Rust construction, however, the Bolly apparatus is assembled and supported by reliance upon some suspension from a ceiling and thus is adapted to exclusively be used indoors as that access to a ceiling is required to support the maze. Thus, while the Bolly side panels are at least lighter, the structure still does not go far enough to allow a parent to set up the apparatus quickly and be easily transportable by that parent and used in locations either outdoors or indoors with equal facility.

Therefore, as can be seen, the prior art simply does not provide a maze game apparatus that is light, comprised of readily transportable components by a parent, and which is adaptable to be as easily set up indoors as well as outdoors. Thus, it would be advantageous to have such a maze and particularly one that could be made of easily washable materials, adjustable for varying conditions and have standard component for inexpensive manufacture as well as to allow the overall apparatus to be stored by the user without having cumbersome parts.

SUMMARY OF THE INVENTION

Now, in accordance with the present invention, there is provided a new and improved apparatus for the establishing of a maze game for play by children. With the present apparatus, all of the materials and components are light weight and can easily be transported from location to location by a parent or parents so that the game can be set up at any variety of locations and can even be taken to a public park or recreational area along with the children to create the maze at that location.

The present apparatus is capable of being used indoors or outdoors such that the children can play outside with the game or inside during the colder months or during inclement weather. In either case, the present invention provides an apparatus that can readily adapt to the particular location or conditions.

In the present invention, the components are, as indicated, light weight to make the overall apparatus portable however such components are sufficiently strong so as to be assembled and remain in place during the playing of the game. The maze apparatus comprises a plurality of vertically disposed poles. The poles may be a hard, impact resistant plastic material or of a light metal, such as aluminum, it only being important that the material be light, easily transported and yet be sufficiently strong to provide support for the overall apparatus. At the upper portion of each of the vertical poles, there are sets of holes provided and each set may be comprised of two or more holes in the poles. In the preferred embodiment, there are four holes in each set located about ninety degrees apart, that is, equally spaced around the peripheral surface of the poles. There may be two or more sets of such holes in the upper portion of the vertical poles.

The vertical poles are established and maintained in the vertical orientation by the lower ends of the vertical poles establishing a supporting contact with the particular ground or floor on which the maze is to be erected. In particular, if the maze is intended to be constructed outdoors, the lower ends of the vertical poles are pointed and can simply be driven into the ground to establish the vertical orientation. If, on the other hand, the maze is intended to be set up and used indoors, the lower ends of the vertical poles can be comprised of generally flat, planar, weighted bottoms so as to enable the vertical poles to stand independently on a flat floor and be orientated vertically.

In the preferred embodiment the vertical poles are supported in the alternative locations by means of a lower adapter section that is affixed to the lower end of a vertical pole. Thus, there can be differing lower adapter sections to be affixed to the vertical poles and one of such lower adapter sections can be formed with a pointed end to be used in the outdoor environment while another lower adapter section can be formed with a relatively large flat, planar bottom surface so as to allow the vertical post to stand on a floor or carpet within a home without damaging that floor or carpet. Accordingly, the parent, in the preferred embodiment, can have the option of setting up the present maze apparatus in either location with the use of the same basic components.

With the present invention, there are also a plurality of horizontal poles and which have their ends interfitted into the one of the selected sets of holes in the vertical poles such that each horizontal pole interconnects a pair of vertical poles and the horizontal poles are supported by being force fitted into the holes formed in the upper portion of the vertical poles. In the preferment embodiment, the horizontal poles are comprised of the same light weight material as the vertical poles and are only somewhat smaller in cross sectional area.

As is now obvious, with the differing sets of holes in the vertical poles, the horizontal poles can be interfitted to a desired set of holes at the vertical height off of the floor or ground to fit the height of the children and thus the parent can simply select the particular set of holes that is most applicable to the children playing the game. Again, as preferred, the various sets of holes at the varying heights can be color coded, that is, the sets of holes at each height can have the same color to enable the user to easily select and use a particular set of holes at the desired height from the ground by merely using a consistent color of holes to set up the apparatus and to install the horizontal poles.

The maze apparatus is completed by the use of a flexible, light fabric panels that are suspended from the horizontal poles and which hang down at least substantially the entire height of the vertical poles. It is preferred that the panels be comprised of a light fabric so that the visibility of the children to see into any adjoining path is curtailed and yet the overall apparatus is sufficiently light that it can be readily moved at will by the parent. Preferably, the fabric can be similar to or actual bedroom sheets that are also readily available to anyone for use in the game. It is certainly preferred that the fabric be readily washable, and fire retardant for indoor use and one such material is a fire retardant nylon webbed sheeting.

Accordingly, with the use of a fabric, the overall apparatus can be light and easy to transport to any location. In the preferred embodiment, the fabric panels are affixed to the horizontal poles by a quick and sure means including the use of tabs or loops that are affixed to the upper edges of the fabric and can be looped around the horizontal poles and reattached to the fabric and can be the use of hooks and loops arrangement currently available under the trademark Velcro. In a preferred embodiment, the may be sets of Velcro at the ends of the fabric vertically separated as the panels are looped over the horizontal poles. By the use of different sets of Velcro fasteners, at a plurality of spaced vertical locations along the fabric panels, the user can easily change the vertical height of the panels to account for different terrain or for different selected holes in the vertical poles by merely further looping the fabric panel over the horizontal poles and selecting a different set of Velcro fasteners.

Thus, the maze of the present invention is simple to set up and take down, is lightweight so as to be readily portable, and also has the adaptability to be used with children of differing heights for the carrying out of a game indoors or outdoors.

These and other improvements and features of the present invention will become better understood from the detailed description of the preferred embodiment set forth below taken in conjunction with the accompanying drawings.

DETAILED DESCRIPTION OF THE INVENTION

Figure 1:
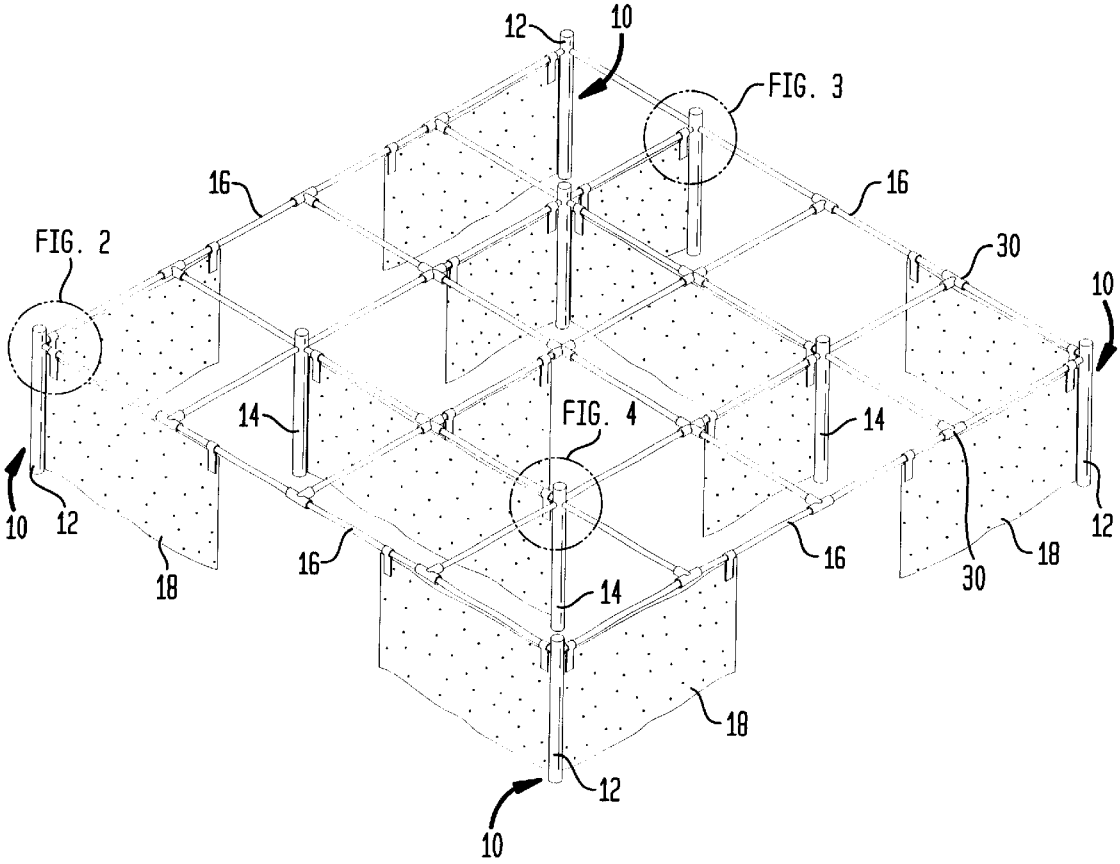
FIG. 1 is a perspective view of a maze apparatus constructed in accordance with the present invention and set up for use by children.

Turning not to FIG. 1, there is shown a perspective view of a maze apparatus set up for the playing of a game by children. As can be seen, there are a plurality of vertically oriented poles 10 and which are used to establish and set up the overall maze game. For purposes of the present description, the vertical poles 10 will be referred to as outside vertical poles 12 and inside vertical poles 14, however, as will later be explained, the outside and inside vertical poles 12, 14 may be identical. The vertical poles 10, in general, are disposed a predetermined distance from each other and are affixed to the ground or to a floor in a manner that will later become clear.

It is clear, however, from FIG. 1, that there may be any number of vertical poles 10 to set up the maze depending, of course, upon the complexity of the desired maze and/or the amount of room available at the particular location.

As can also be seen in FIG. 1, there are a plurality of horizontally oriented members or horizontal poles 16 that interconnect the vertical poles 10 generally at the upper portion of the vertical poles 10 to make up the overall maze apparatus. As will be seen, again, the actual number of horizontal poles 16 is up to the user and is dependent upon the availability of space and the desired complexity of the game. As will also become apparent, although there is shown a particular configuration in FIG. 1 as an example, by the use of the present invention and the interconnecting of the horizontal poles 16 and the vertical poles 10, there can be any number of configurations that can be set up by the parent to vary the game for the participants and to increase or decrease the complexity of the maze.

Thus, there are a plurality of panels 18 that are affixed to the horizontal poles 16 and extend downwardly at least substantially the entire height of the vertically oriented vertical poles 10. Preferably, the panels 18 are comprised of a light weight fabric so that the overall apparatus can be light and easily carried to the particular site to be used for the game, and any non-transparent fabric can be used that is relatively strong, preferably a common household bed sheet or like fabric can be employed.

Thus, not only are the vertical poles 10 and the horizontal poles 16 adaptable and can be constructed by the user to any particular configuration, but once the overall frame of the horizontal poles 16 and vertical poles 10 are erected, the panels 18 can be moved or positioned to suit the user and once a game has been played, the panel 18 can simply be removed easily from the horizontal poles 16 and affixed to a different horizontal pole to vary the next game. Accordingly, with the present construction, not only can the parent vary the game easily, but the children themselves can use their imagination and change the game as it suits them without requiring any extensive breaking down of the basic maze structure and a rebuilding process.

Figure 2:
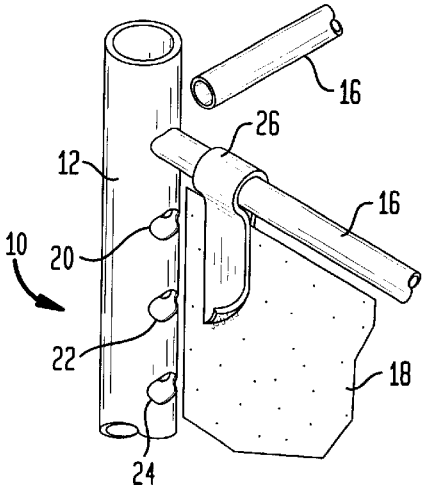
FIG. 2 is an enlarged perspective view of a typical upper connection of a vertical pole used with the present invention.

Turning now to FIG. 2, there is shown an enlarged perspective view of an outside vertical pole 12 and having interfitted thereto a horizontal pole 16 and showing a further exploded view of a horizontal pole 16 to be interfitted to the outside vertical pole 12. As can be seen, the outside vertical pole 12 has a plurality of sets of holes 20, 22, 24 that are formed therein. In FIG. 2, only one hole of each of the sets if visible however it is obvious that there is at least another hole for locating the other horizontal pole interfitted to the outside vertical pole 12. Accordingly, in the construction of the maze apparatus, the outside vertical pole 12 is initially affixed in its vertical orientation and the construction is furthered by interfitting horizontal poles 16 into one of the sets of holes 20, 22, 24. By the use of different sets of holes 20, 22, 24, the user can choose the proper height of the maze apparatus depending upon the height of the children intending to play the game. The interfit of the horizontal poles 16 into one of the sets of the holes 20, 22, 24, can be by means of a force fit so that the interconnecting and removal of the horizontal poles 16 with respect to any of the vertical pOoles 10 is easy to facilitate.

In the preferred embodiment, each set of holes is color coded to enable the user to set up the apparatus easily and accurately by simply using the holes of a certain color and thus inserting the horizontal poles consistently into that set of color coded holes.

In addition, with respect to FIG. 2, it can be seen that the fabric panel 18 is affixed to the horizontal pole 18 by means of a loop 26 that encircles the horizontal pole 16 to be affixed to suspend the fabric panel 18. Various means can be used to carry out that affixation of the top of the panel 18 to the horizontal pole 16 that is easy to attach and detach, however, in the preferred embodiment, there is a conventional hook and loop affixing device available under the trademark Velcro to carry out the affixing of the panels 18 to the horizontal poles 16.

In the preferred embodiment there may be a plurality of sets of Velcro fasteners spaced horizontally along the panels 18 when installed to a horizontal pole. The use of the horizontally spaced fasteners allows the user to fasten the panel 18 at, for example, spaced locations every foot across the horizontal disposition of the of the panels 18, that is, with the preferred width of about four feet across the horizontal, there may be four sets of Velcro fasteners.

There can also be a plurality of sets of vertically disposed Velcro fasteners when the panels are installed overlooping a horizontal pole 16 to enable the user to easily change the vertical drop of each panel by simply selecting a different set of vertically disposed fasteners. Thus, if the particular panel 18 is too long, the user can simply fold the upper end of that panel further over the horizontal pole to the next set of vertical Velcro fasteners and attach the panel in that raised position. Thus, with varying vertically located fasteners, the panels 16 can be easily adjusted as to the vertical height to adapt the panels to the particular vertical space between any horizontal pole and the surface on which the apparatus is set up, i.e. the ground or the floor of a building.

Figure 3:
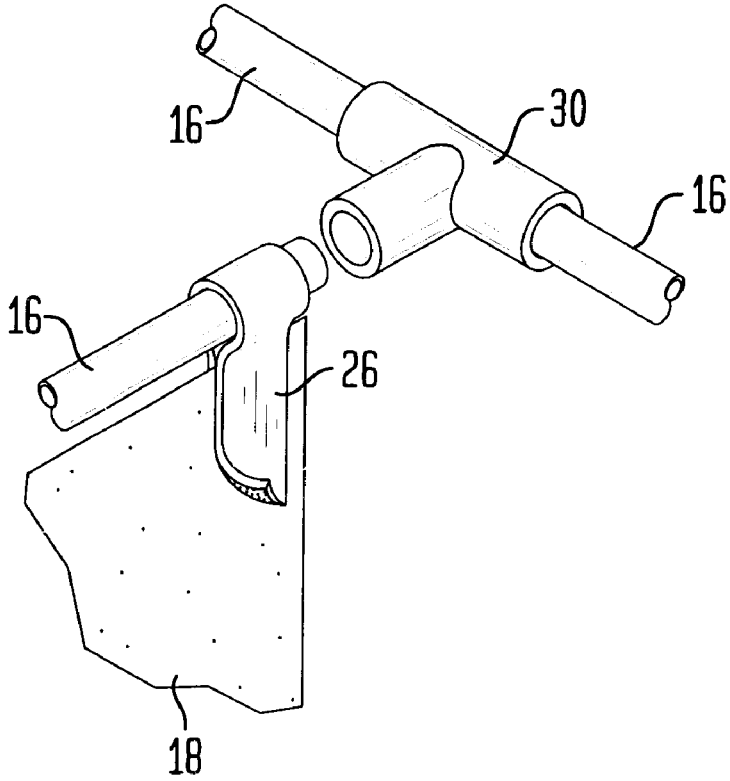
FIG. 3 is an enlarged perspective view of a typical junction of horizontal poles, used with the present invention.

Turning now to FIG. 3, there is shown an enlarged perspective view of a tee connector 30 that is used to connect various horizontal poles 16 together and, again, with the tee connector 30, the horizontal poles 16 can be affixed to the tee connector 30 by means of an interference fit so as to make the connection easily and to allow the overall maze apparatus to be readily taken down after the game has been completed. Again, as can be seen, the panel 18 can be preferable affixed to the horizontal pole 16 by the user of a loop 26 having a connector of Velcro material.

Figure 4:
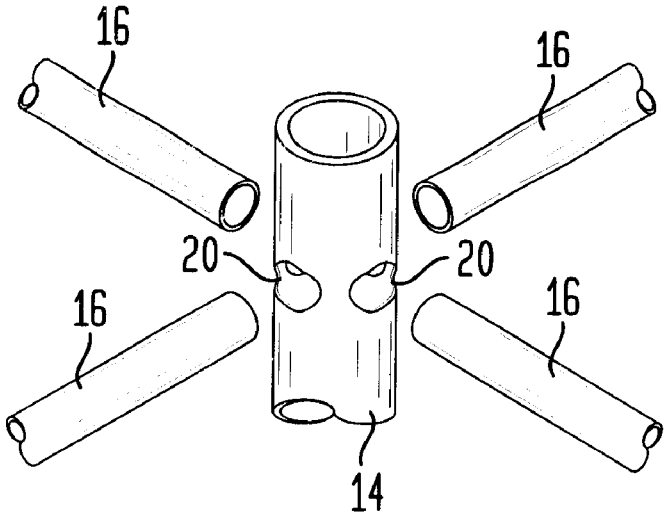
FIG. 4 is an enlarged perspective view of a typical interior vertical pole connection of the present invention.

Turning now to FIG. 4, there is shown a enlarged perspective view of a inside vertical pole 14 and showing one set of holes 20 formed in that inside vertical pole 14. The affixation of the horizontal pole 16 is shown in an exploded view and the horizontal poles 16 are interfitted by means of a force fit into the set of holes 20. As can be seen in the view, the set of holes 20 comprise four holes, spaced around the periphery of the upper portion of the inside vertical pole 14, or about ninety degrees apart so that a horizontal pole 16 can be interfitted from all four directions.

The use of four holes per set is intended for an inside vertical pole 14 as opposed to an outside vertical pole 12 of FIG. 2, however, for uniformity, the inside and outside vertical poles 12, 14 can be made identically with both having four circular holes for each set of holes for simplicity of manufacture and for more versatility in setting up and establishing the particular maze game. As noted in FIG. 4, there is only one set of holes 20 shown; it being understood that the inside vertical pole 14 would have the same plurality of sets of holes as described with respect to FIG. 2 so that the user can choose the particular vertical height from the ground or floor for the panels 18 to match the height of the children playing the game. Again, as noted, each set of holes is preferable color coded.

Figure 5A:
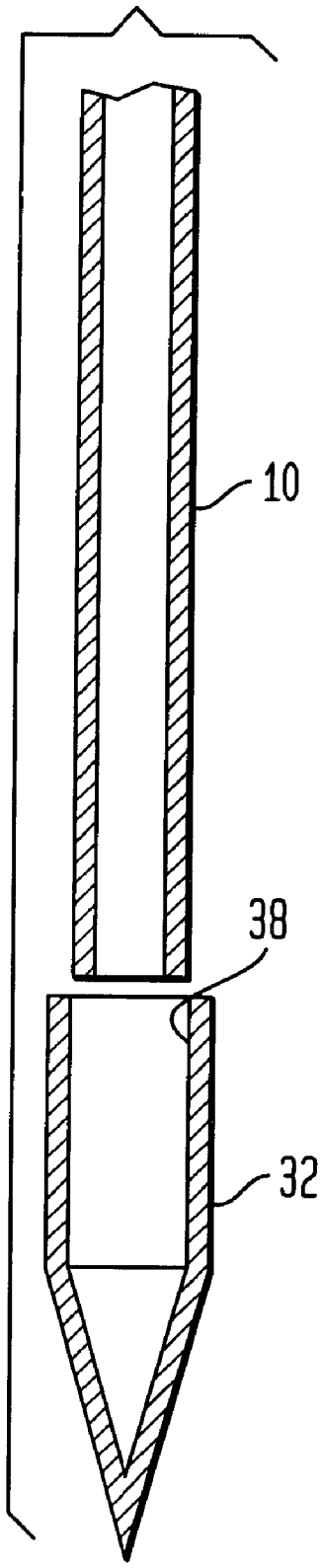
FIGS. 5A and 5B are side cross-sectional views of a lower adapter section for use, respectively, to set up the present apparatus on the outside ground and in the interior of a building.
Figure 5B:
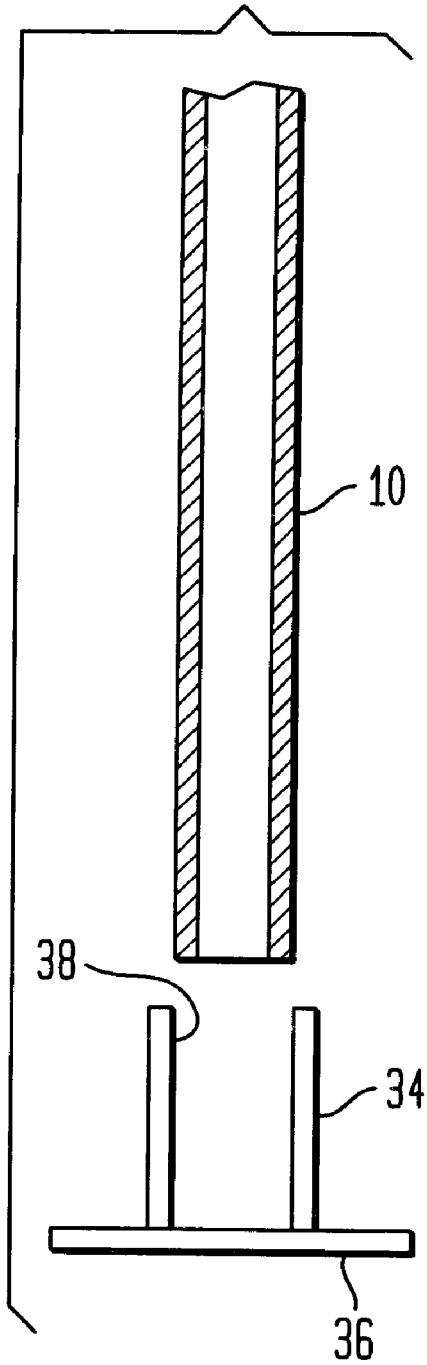

Turning finally to FIGS. 5A and 5B, there is shown, side cross sectional views of a lower pointed adapter section 32 in FIG. 5A that is used to enable the vertical poles 10 to be driven into the ground by the user in the event the maze apparatus is being set up outdoors and, in FIG. 5B, a lower flat adapter section 34 having a flat, planar bottom 36 for use when the maze apparatus 10 is used indoors and the vertical poles 10 are to be located on a hard floor or carpeted floor within a building. As can be seen the lower, flat planar bottom 36 is kept low to the ground to prevent children from inadvertently tripping during their use of the maze apparatus.

Thus, with either of the adapters, the maze game can be easily set up in either location and converted readily to be set up inside the house of other building or, alternatively, the maze apparatus can be set up so as to be used outdoors. In either installation, the lower end of the vertical pole 10 can be interfitted into an opening 38 in that particular adapter and the interchanged easily by the user as desired.

While the preferred embodiments have been described and illustrated, various modifications and substitutions may be made without departing from the scope and spirit of this invention. It is to be understood, therefore that the present invention has been described by way of illustration and not limitation.

I claim:

1. A maze apparatus for use in connection with a children's game, said apparatus comprising a plurality of vertically oriented poles, said vertically oriented poles each having a plurality of sets of holes, each of said plurality of holes comprising at least two holes spaced at a angular degree apart around the outer periphery of each of said vertical oriented poles, said sets of holes being separated by a predetermined vertical distance, a plurality of horizontal poles interfitted into any one of said sets of holes in said vertically oriented poles so as to create a span between said vertically oriented poles, and fabric panels affixed to said horizontal poles and extending downwardly freely a distance at least substantially the full height of said vertical poles, said downward extension of said fabric panels being adjustable by interfitting said plurality of horizontal poles into differing sets of holes in said vertically oriented poles, whereby said vertical poles said horizontal poles and said fabric panels combine to form a pathway to conceal a child within that pathway.

2. A maze apparatus as defined in claim 1 wherein said vertical poles have a flat planar bottom to enable said vertical poles to stand upright on a flat surface.

3. A maze apparatus as defined in claim 1 wherein said poles have lowered tapered ends to enable said poles to be forced into the ground to achieve said vertical orientation.

4. A maze apparatus as defined in claim 1 wherein said vertical and horizontal poles are comprised of a light impact resistant plastic material.

5. A maze apparatus as defined in claim 1 wherein each of said sets of holes comprises at least two holes spaced apart about ninety degrees.

6. A maze apparatus as defined in claim 5 wherein each set of holes comprises four holes at about ninety degrees apart around periphery of said vertically oriented poles.

7. A maze apparatus as defined in claim 1 wherein each of said fabric panels includes fastening devices to enable said fabric panels to be looped over at least one horizontal pole and attached to itself.

8. A maze apparatus as defined in claim 7 wherein said fastening devices are loop and hook fasteners known as Velcro fasteners.

9. A maze apparatus as defined in claim 7 wherein said fastening devices comprises sets of fastening devices oriented in at least the horizontal or vertical direction along said fabric panels.

10. A maze apparatus as defined in claim 7 wherein said sets of fastening devices are orientated along said horizontal and vertical directions.

11. An apparatus as defined in claim 7 wherein said fastening devices comprise Velcro fasteners.

12. An apparatus as defined in claim 7 wherein said plurality of sets of fastening devices are spaced along both the length and width of said fabric panels.

13. An apparatus for use in setting up a maze game for children, said apparatus comprising a plurality of vertically oriented poles of about the same length, at least some of said poles each having a plurality of sets of holes, each of said plurality of holes comprising at least two holes spaced at a angular degree apart around the outer periphery of at least some of said poles, said sets of holes being separated by a predetermined vertical distance, a plurality of horizontal poles interfitted into any one of said sets of holes in said vertically oriented poles, a plurality of fabric panels of predetermined length and width dimensions comprised of a washable material, said fabric panels having a plurality of sets of fastening devices spaced along at least one of the length and width of said fabric panels to affix said fabric panels to said horizontal poles such that said fabric panels hang freely downwardly a distance from said horizontal poles, said downward distance established by interfitting said horizontal poles into differing sets of holes in said vertically oriented poles.

14. A maze apparatus for use in connection with a children's game, said apparatus comprising a plurality of vertically oriented poles, said vertically oriented poles each having a plurality of sets of holes, each of said plurality of holes comprising at least two holes spaced apart about ninety degrees around the outer periphery of each of said vertical oriented poles, each of said sets of holes being selectively colored with a particular different color, said sets of holes being separated by a predetermined vertical distance, a plurality of horizontal poles interfitted into said holes in said vertically oriented poles so as to create a span between said vertically oriented poles, and fabric panels affixed to said horizontal poles and extending downwardly at least substantially the full height of said vertical poles, whereby said vertical poles said horizontal poles and said fabric panels combine to form a pathway to conceal a child within that pathway.

* * * * *